US009031443B2

(12) United States Patent
Kaida et al.

(10) Patent No.: US 9,031,443 B2
(45) Date of Patent: May 12, 2015

(54) IMAGE FORMING APPARATUS

(71) Applicant: Canon Kabushiki Kaisha, Tokyo (JP)

(72) Inventors: Yoshiteru Kaida, Numazu (JP); Yasuharu Hirado, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 88 days.

(21) Appl. No.: 13/685,120

(22) Filed: Nov. 26, 2012

(65) Prior Publication Data

US 2013/0136481 A1 May 30, 2013

(30) Foreign Application Priority Data

Nov. 28, 2011 (JP) ..... 2011-259222
Nov. 5, 2012 (JP) ..... 2012-243589

(51) Int. Cl.
*G03G 15/20* (2006.01)
*G03G 21/20* (2006.01)

(52) U.S. Cl.
CPC ..... *G03G 15/205* (2013.01); *G03G 15/2078* (2013.01); *G03G 21/20* (2013.01); *G03G 15/2039* (2013.01)

(58) Field of Classification Search
CPC ..... G03G 15/2053; G03G 2215/2035; G03G 9/08797; G03G 15/2017; G03G 15/205; G03G 15/2039; G03G 15/2064; G03G 15/2042; G03G 15/2057
USPC ..... 399/69, 70, 12, 33
See application file for complete search history.

(56) References Cited

U.S. PATENT DOCUMENTS

| | | | | |
|---|---|---|---|---|
| 7,177,561 | B2 | 2/2007 | Serita | |
| 2006/0127119 | A1* | 6/2006 | Sato | 399/69 |
| 2006/0222385 | A1 | 10/2006 | Serita | |
| 2008/0226323 | A1* | 9/2008 | Park | 399/68 |
| 2010/0196039 | A1* | 8/2010 | Ono | 399/69 |

FOREIGN PATENT DOCUMENTS

| | | | |
|---|---|---|---|
| JP | 11-15219 | A | 1/1999 |
| JP | 2004-13015 | A | 1/2004 |
| JP | 2006-145968 | A | 6/2006 |
| JP | 2006-285253 | A | 10/2006 |
| JP | 2006-317512 | A | 11/2006 |

* cited by examiner

*Primary Examiner* — Roy Y Yi
(74) *Attorney, Agent, or Firm* — Fitzpatrick, Cella, Harper & Scinto

(57) ABSTRACT

An image forming apparatus includes an image forming station for forming an unfixed image on a recording material; a fixing portion for heating and fixing an unfixed image formed on the recording material, the fixing portion including a fixing rotatable member, and a pressing roller cooperative with the fixing rotatable member to form a nip for nipping and feeding the recording material; an ambient condition sensor for detecting an ambient temperature and an ambient humidity; and a controller for controlling the fixing portion; wherein the controller sets such a warming-up time for warming up the fixing portion that a temperature of the pressing roller at the time when the recording material enters the nip is a temperature calculated on the basis of the ambient temperature and the ambient humidity.

22 Claims, 10 Drawing Sheets

(a)

| RELATIVE HUMIDITY | WATER CONTENT |
|---|---|
| 10 | 3.1 |
| 50 | 6.5 |
| 60 | 7.2 |
| 70 | 8.6 |
| 80 | 9.5 |

(b)

(a)

| W.CONTENT | PRESS.RLR.TEMP. |
|---|---|
| 7.2 | 70.1 |
| 8.6 | 89.3 |
| 9.5 | 99.7 |

(b)

(a)

| ANTI-DEW SEQUENCE TIME | TEMP.RISE OF PRESS.RLR |
|---|---|
| 0 | 0 |
| 1 | 6.3 |
| 2 | 11.3 |
| 3 | 15.2 |
| 4 | 18.7 |
| 5 | 24.2 |
| 6 | 26.7 |
| 7 | 29.6 |
| 8 | 32.4 |
| 9 | 34.6 |

(b)

(a)

| W.CONTENT | PRESS.RLR.TEMP. |
|---|---|
| 7.2 | 60.6 |
| 8.6 | 70.1 |
| 9.5 | 89.3 |

(b)

IMAGE FORMING APPARATUS

FIELD OF THE INVENTION AND RELATED ART

The present invention relates to an image forming apparatus of an electrophotographic recording type such as a copying machine or a printer having a function of forming an image on a recording material such as a sheet.

The image forming apparatus of the electrophotographic recording type comprises a fixing device for heating and fixing an unfixed toner image on the recording material. When a printing operation starts in a state that the fixing device is cool, water vapor produced from the first recording material passing a fixing portion may condensate on a pressing roller. When a subsequent recording material enters the fixing portion in the state of dew condensation on the surface of the pressing roller, the recording material may slip in the fixing portion, with the result of an image defect or jamming of the recording material.

Japanese Laid-open Patent Application 2006-317512 discloses a method for suppressing slip of the recording material factors attributable to the dew condensation. More specifically, a temperature of the pressing roller is deduced, and if the temperature of the pressing roller is discriminated as causing the dew condensation, sheet feed timing of the subsequent recording material is delayed to warm the pressing roller, that is, a feeding interval of the recording materials is expanded.

However, in Japanese Laid-open Patent Application 2006-317512, the delay of the sheet feed timing is constant. Therefore, even when the temperature of the pressing roller reaches already the temperature not producing the dew condensation, the sheet feeding does not start until the set delayed time elapses, and therefore, the printer cannot operate to its high power.

SUMMARY OF THE INVENTION

Accordingly, it is a principal object of the present invention to provide an image forming apparatus with which the decrease of the processing speed can be suppressed even when it is used under the condition that the dew condensation occurs on the pressing roller.

It is another object of the present invention to provide an image forming apparatus in which the warming period for the pressing roller can be set properly.

According to an aspect of the present invention, there is provided an image forming apparatus comprising: an image forming station for forming an unfixed image on a recording material; a fixing portion for heating and fixing an unfixed image formed on the recording material, said fixing portion including a fixing rotatable member, and a pressing roller cooperative with said fixing rotatable member to form a nip for nipping and feeding the recording material; an ambient condition sensor for detecting an ambient temperature and an ambient humidity; and a controller for controlling said fixing portion, wherein said controller sets such a warming-up time for warming up said fixing portion that a temperature of said pressing roller at the time when the recording material enters the nip is a temperature calculated on the basis of the ambient temperature and the ambient humidity.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated.

Embodiment 1

As regards the dew condensation on fixing means (fixing member), an ambient temperature, an ambient humidity (relative humidity), a water content of paper, and a temperature of the fixing means not resulting in the dew condensation are important factors, which are interrelated each other. In Embodiment 1, therefore, the ambient temperature, the relative humidity, the water content of the paper, and the temperature of the fixing means not resulting in the dew condensation are calculated, and from the results of the calculation, the extention period (time) of the pre-rotation is calculated, so that a required minimum extension time is calculated.

In more detail, in this embodiment, the water content of paper is calculated from the relative humidity, the temperature capable of preventing the dew condensation on the fixing means is calculated from the water content of paper, an execution time of the dew condensation countermeasurement sequence is calculated from the calculated temperature and the ambient temperature, and a control is carried out on the basis of the calculations. In this embodiment, the water content of paper is a ratio of a water content contained in a recording material relative to the recording material.

Figure 1:
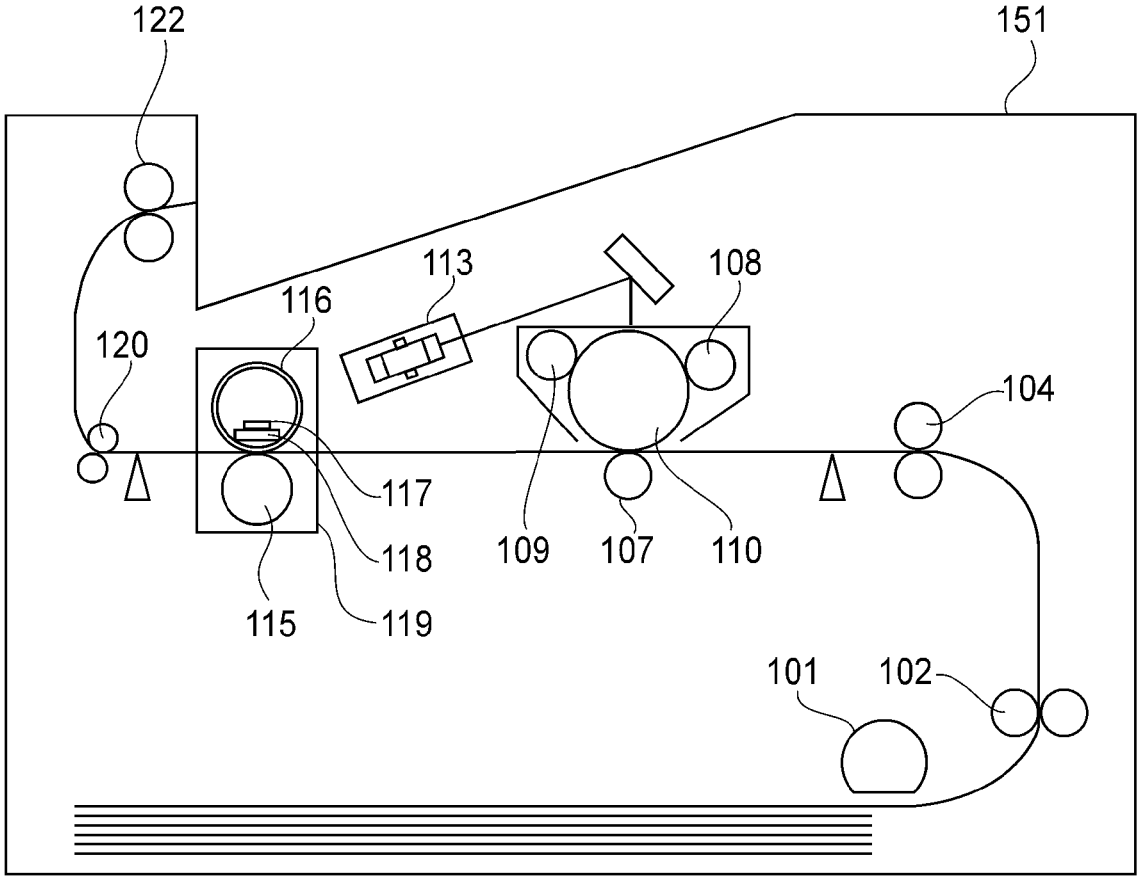
FIG. 1 is a sectional view illustrating a schematic of an image forming apparatus according to Embodiment 1 of the present invention.

FIG. 1 is a sectional view illustrating a schematic structure of an image forming apparatus according to this embodiment.

The image forming apparatus 151 comprises a sheet feeding roller 101, feeding rollers 102, 104, 120, 122, a photosensitive drum 110, a charging roller 109 the scanner unit 113, a developing roller 108, a transfer roller 107 and a fixing unit 119.

Here, the sheet feeding roller 101 feeds a sheet as the recording material, and the feeding rollers 102, 104, 120, 122 feed the sheet fed by the sheet feeding roller 101. Photosensitive drum 110 forms an image on the sheet. The charging roller 109 charges the photosensitive drum 110. The scanner unit 113 forms an electrostatic latent image on the photosensitive drum 110. The developing roller 108 develops the electrostatic latent image on the photosensitive drum 110. The transfer roller 107 transfers a toner image provided by the development onto the sheet. The fixing unit 119 nips and feeds the sheet having the unfixed toner image by the fixing nip formed between the heater 118 and the pressing roller 115 through the fixing film 116 to fix the toner on the sheet. The photosensitive drum 110, the charging roller 109, the scanner unit 113, the developing roller 108 and the transfer roller 107 constitutes an image forming station which functions to form the electrostatic latent image on the image bearing member in accordance with the image formation instructions to transfer the toner image provided by the development of the electrostatic latent image.

Figure 2:
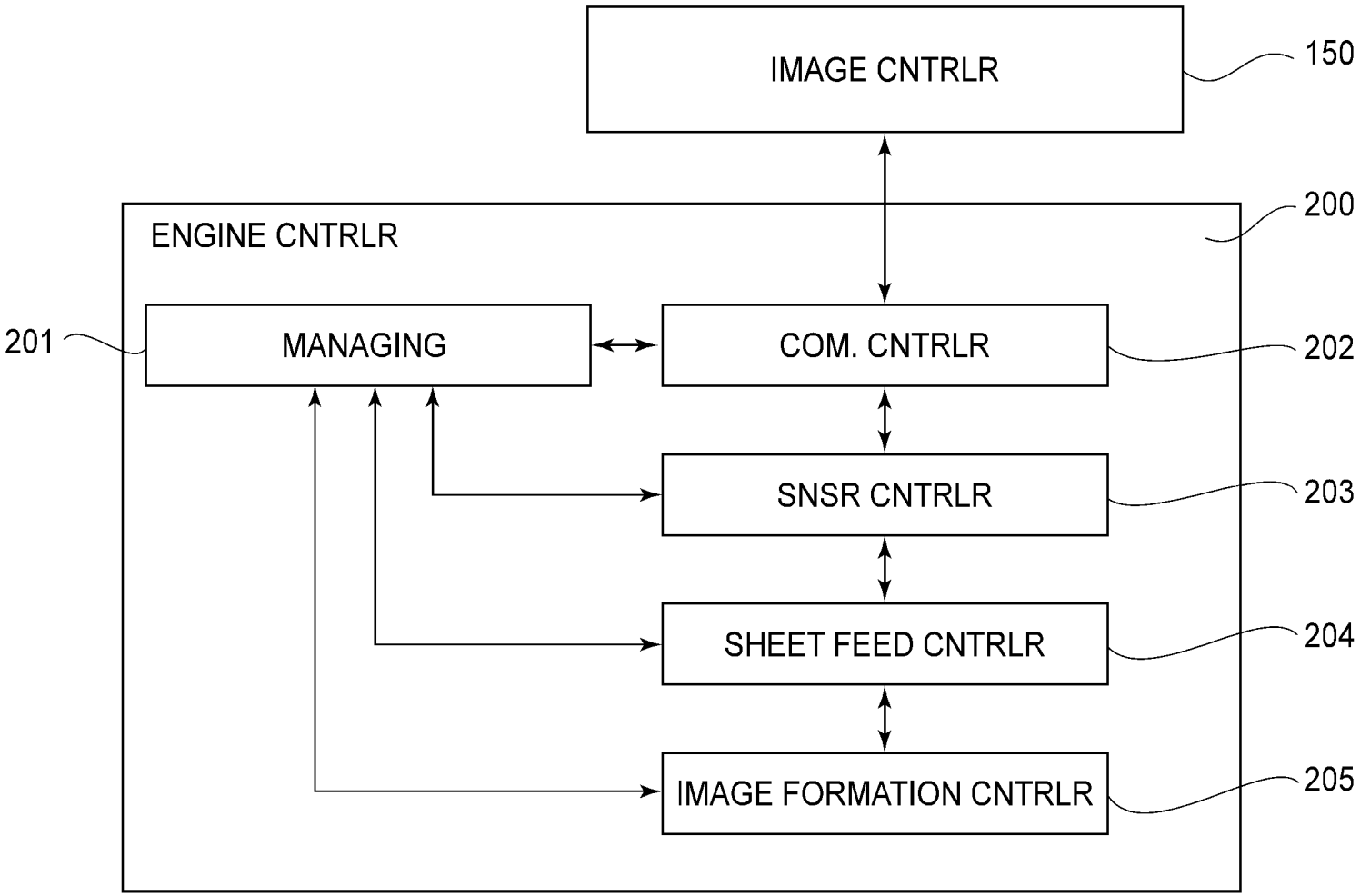
FIG. 2 is a block diagram of a control system of the image forming apparatus of embodiment 1.

FIG. 2 is a block diagram of a control system of the image forming apparatus.

The image controller 150 receives a print requirement and/or image data from a PC (personal computer) or the like and sends print starting instructions and/or image data as image formation instructions to an engine controller 200. The engine controller 200 comprises a CPU for controlling the entirety image forming apparatus, a ROM storing control programs, a RAM for storing data or the like, and gate elements and so on. The engine controller 200 corresponds to a controller capable of executing the dew condensation countermeasurement sequence.

The engine controller 200 includes a managing portion 201 for managing each function. The managing portion 201 controls the controller including a communication controller 202, a sensor input detecting portion 203, a sheet feed controller 204, an image formation controller 205.

The communication controller 202 is a controller for receiving command from the image controller 150 and for notifying a state of the printer engine. The sensor input detecting portion 203 is a controller for obtaining information from a sensor disposed in a sheet feeding path, a sensor (130) for detecting an ambient temperature and humidity, a sensor (thermister 117) for detecting a temperature of the heater 118 the fixing device. The sheet feed controller 204 is a controller for controlling paper feeding on the basis of the information from the sensor disposed in the sheet feeding path. The image formation controller 205 is a controller for controlling the voltages (high voltages) for applying to the charging roller 109, the developing roller 108 and the transfer roller 107, and for controlling the scanner unit 113 and the fixing unit 119.

Figure 3:
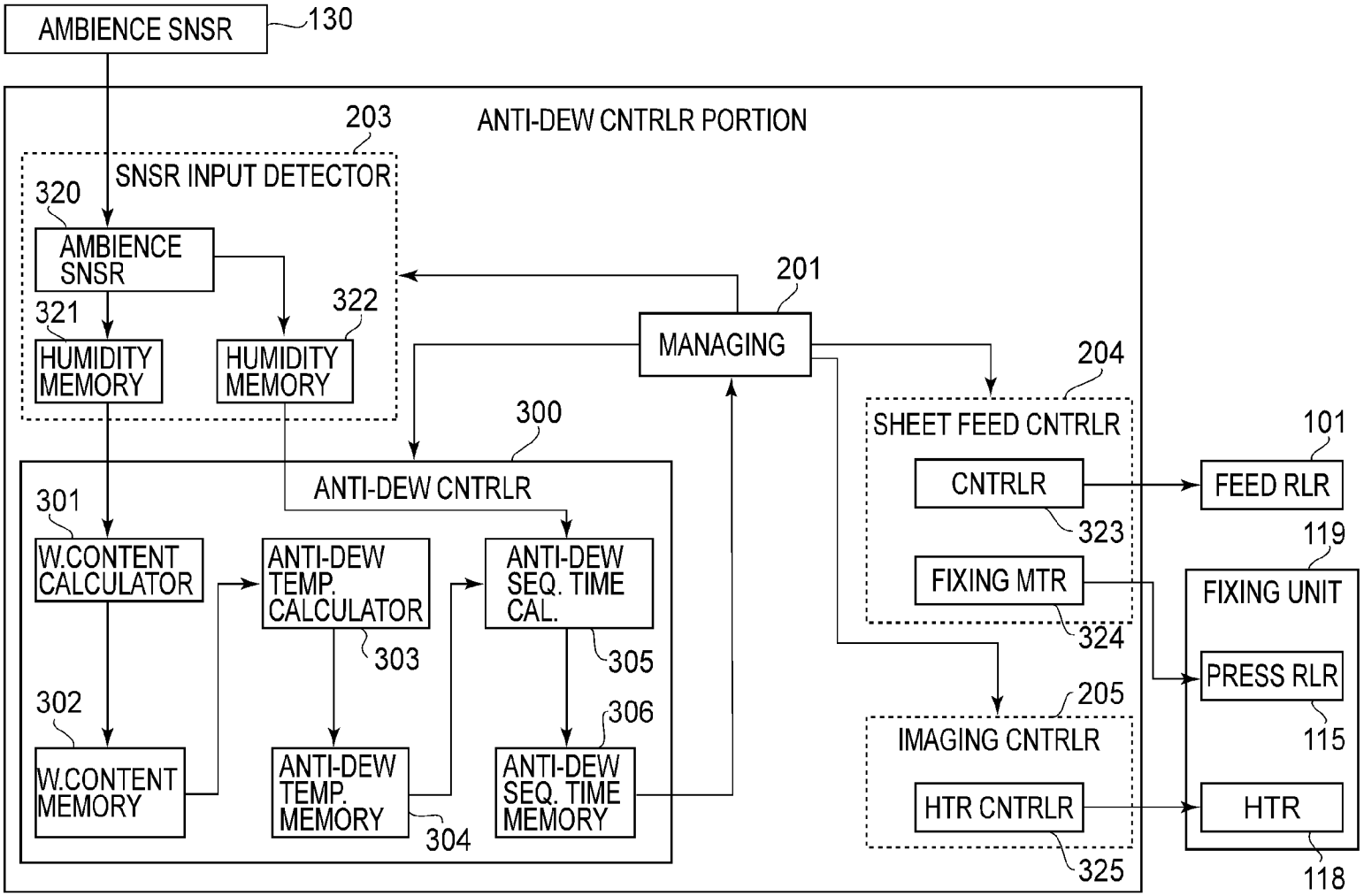
FIG. 3 is a block diagram of a controller relating to a dew condensation countermeasurement control according to embodiment 1.

FIG. 3 is a block diagram showing a controller relating to a dew condensation countermeasurement controller for carrying out the dew condensation countermeasurement control of this embodiment. The managing portion 201 is a controller for managing respective controllers. The sensor input detecting portion 203 converts an input voltage from the ambient condition sensor 130 (ambient condition detector 320) a digital value by an A/D converter of the CPU and converts the digital value to a temperature (degree C.). It causes the humidity and the temperature in an ambient humidity storing portion 321 and in an ambient temperature storing portion 322.

The sheet feed controller 204 includes a sheet feed controller 323 and a fixing motor controller 324. The sheet feed controller 323 controls driving of the sheet feeding roller 101 to control sheet feed timing in the printing operation. The fixing motor controller 324 controls the driving of the pressing roller (pressing roller) 115 of the fixing unit 119. The heater controller 325 of the image formation controller 205 controls electric power to the heater 118 of the fixing unit 119 in accordance with the detected temperature of the thermister 117 for detecting the temperature of the heater 118.

{0016} dew condensation countermeasurement controller (anti-dew controller) 300 includes various controllers which will be described below: That is, a water content calculating portion 301, a water content storing portion 302, a non-dew-condensation-temperature (anti-dew temperature) calculating portion 303, a non-dew-condensation-temperature storing portion 304 and dew condensation countermeasurement sequence time calculating portion 305, and dew condensation countermeasurement sequence time storing portion 306. The dew condensation countermeasurement sequence is for a control for delaying the recording material sheet feed timing and warming the pressing roller during the delaying period. The delay time is called in this embodiment "dew condensation countermeasurement sequence time". In this embodiment, the dew condensation particularly of the pressing roller 115 of the parts of the fixing unit 119 is prevented.

The water content calculating portion 301 calculates the water content of the sheet on the basis of the humidity information stored in the ambient humidity storing portion 321. The calculated water content is stored in the water content storing portion 302. The non-dew-condensation-temperature calculating portion 303 calculates the temperature of the pressing roller 115 at which the dew condensation does not occur (capable of preventing dew condensation on the pressing roller 115), for the water content stored in the water content storing portion 302. The calculated temperature is stored in the non-dew-condensation-temperature storing portion 304. The dew condensation countermeasurement sequence time calculating portion 305 calculates the time (delay time) until the temperature of the pressing roller 115 reaches the temperature stored in the non-dew-condensation-temperature storing portion 304, from the non-dew-condensation-temperature and the ambient temperature stored in the non-dew-condensation-temperature storing portion 304. The dew condensation countermeasurement sequence time calculating portion 305 stores the calculated time in the dew condensation countermeasurement sequence time storing portion 306.

Figure 4:
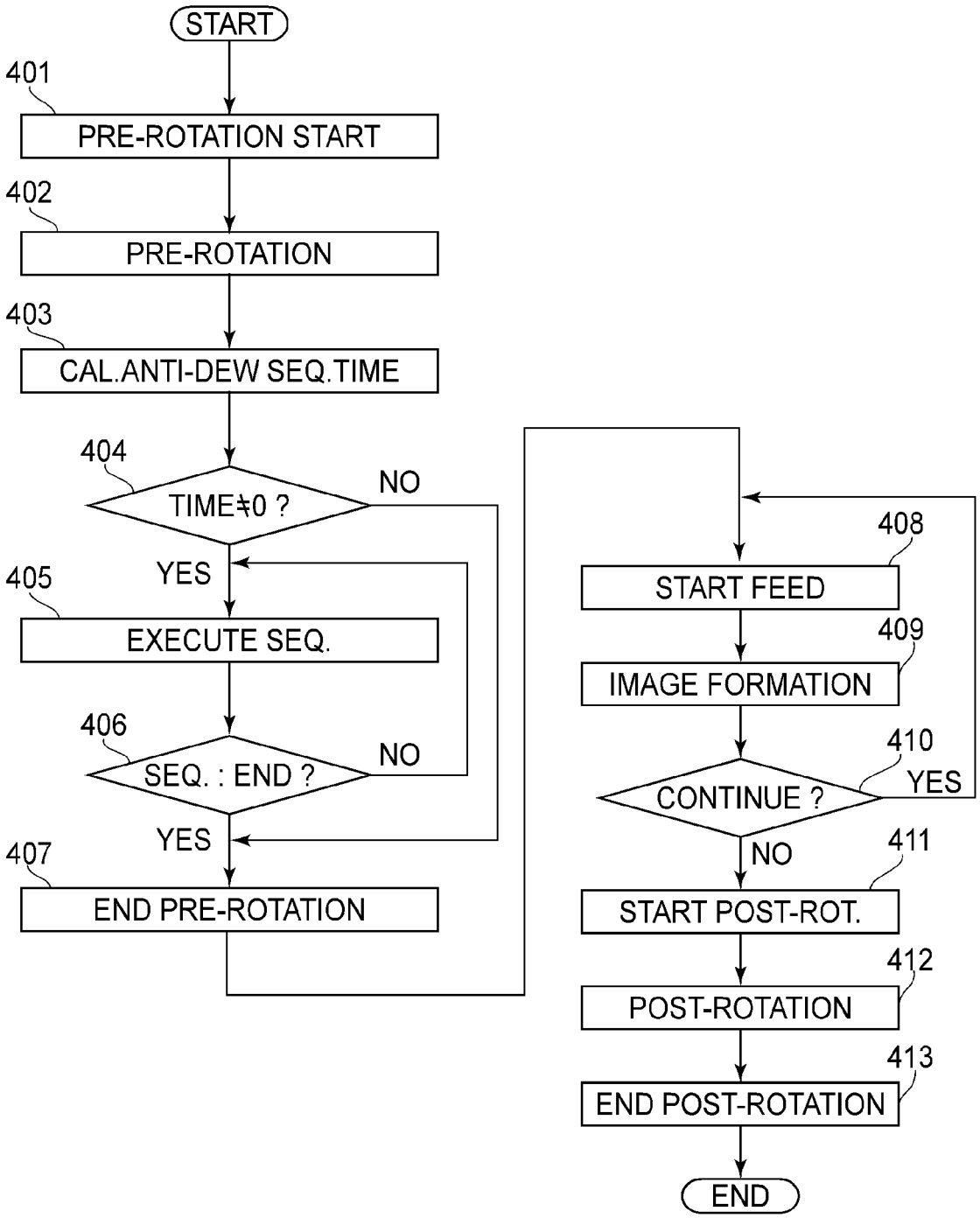
FIG. 4 is a flow chart illustrating the dew condensation countermeasurement control in embodiment 1.

FIG. 4 is a flow chart of the dew condensation countermeasurement control in the printing operation.

When the image forming apparatus receives the print instructions from the image controller 150, it starts a pre-rotating operation ( ) 401), the pre-rotating operation is carried out (402). The pre-rotating operation is a preparing operation for the image forming operation for forming the image on the sheet, and in the pre-rotating operation, the motor drive, the charging, development and transfer voltages, and the temperature control (warming-up) are started.

After the pre-rotating operation execution (start), the dew condensation countermeasurement sequence time (delay time) is calculated (403). When the dew condensation countermeasurement sequence time is not 0 sec (Yes, at 404), the dew condensation countermeasurement sequence control is executed (405) for the dew condensation countermeasurement sequence time period (406). When the dew condensation countermeasurement sequence time is 0 sec in the step 404, the dew condensation countermeasurement sequence control is not executed, and the operation goes to the step 407. When the pre-rotation (407) is completed, the sheet is fed to execute a printing operation to form an image (408, 409).

Thereafter, the reservation and the state of the image forming apparatus are checked to discriminate whether to continue the print or not (410).

If the printing operation is to continue (Yes, 410), the operation returns to the step 408. If the discrimination at the step 410 is the completion of the printing (No, 410), a post-rotating operation is started (411) to carry out the post-processing operation (412), and when the post-rotating operation is completed (413) to finish the printing operation. Here, the post-rotating operation is a post-processing operation in which the motor is stopped, the voltage is made down, and the temperature control of the fixing device is completed.

The calculation of the dew condensation countermeasurement sequence time (delay time) will be described. The measuring conditions under which parameters required to calculate the delay time is as follows:

Paper size: A3;

Kind of paper: CS680 (available from Canon-Kabushiki Kaisha);

Standing condition: a 10 mm stack of print sheets is taken out of a package and stand it for 48 hours; and Printing condition: the printer stands in the off-state for not less than 3 hours, and then the main switch is rendered ON to start printing Control target temperature of the fixing device (heater) in the first sheet processing: 185 degree C.

Under these conditions, the moisture absorbed state of the paper becomes corresponding to the ambient condition because of the long term standing. In addition, the printer is left standing for a long term in the off-state so that a cold (room temperature) start operation is carried out.

Figure 5:
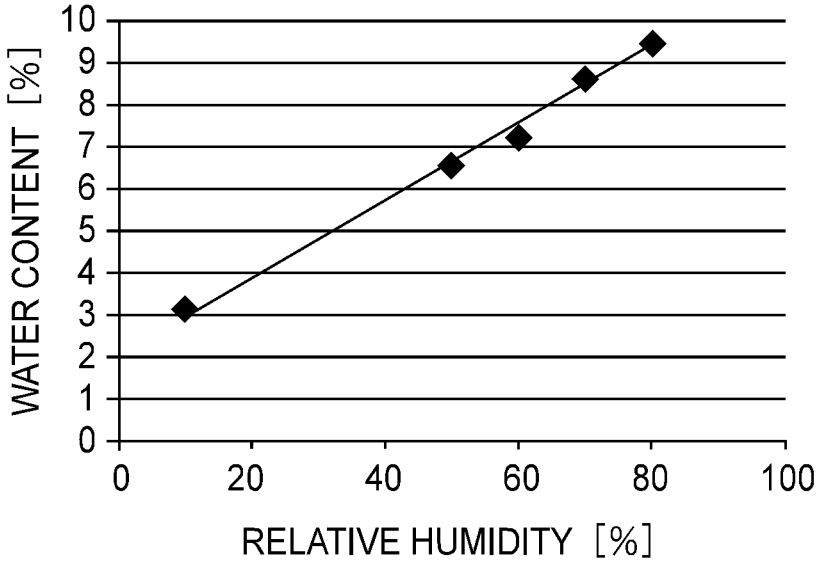
FIG. 5 shows a property between a water content of paper and a relative humidity in embodiment 1.

FIG. 5 is a graph of measured values showing a relation between a water content I of the paper sheet and the relative humidity (ambient humidity where the sheet stands) Henv, in the measuring condition of this embodiment. Part (a) of FIG. 5 shows a relation between the water content I and the relative humidity Henv, and part (b) of FIG. 5 is plots of the data of part (a) of FIG. 5.

By interpolating between plots, the relation between the water content I of paper sheet (%) and the relative humidity Henv (%) can be expressed as follows:

$$I(\%)=0.0919\times Henv+2.0397 \quad (1)$$

Figure 6:
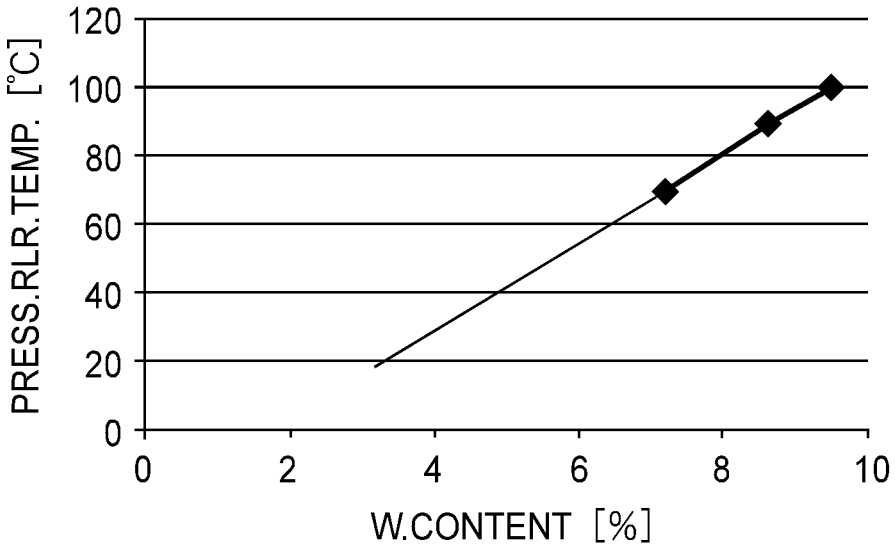
FIG. 6 shows a relation between a non-dew-condensation-temperature and the water content of paper in embodiment 1.

FIG. 6 is a Table of measurements showing a relation between the non-dew-condensation-temperature Tfsr (degree C.) and the water content I of paper sheet (%). Non-dew-condensation-temperature Tfsr is a temperature at which the water vapor generated from the sheet does not condense on the pressing roller 115 when the sheet passes through the fixing portion. Part (a) of FIG. 6 is a Table showing a relation between the non-dew-condensation-temperature Tfsr (degree C.) and the water content I (%), and part (b) of FIG. 6 are plots of the data of part (a) of FIG. 6.

By interpolating between the plots of FIG. 6, the relation between the non-dew-condensation-temperature Tfsr (degree C.) and the water content I (%) can be expressed as follows:

$$Tfsr(\text{degree C.})=12.943\times I-22.785 \quad (2)$$

As shown in FIG. 6, when the water content I is low, that is, the relative humidity is low, it is unnecessary that the pressing roller is not warmed to a high level to suppress the dew condensation.

Figure 7:
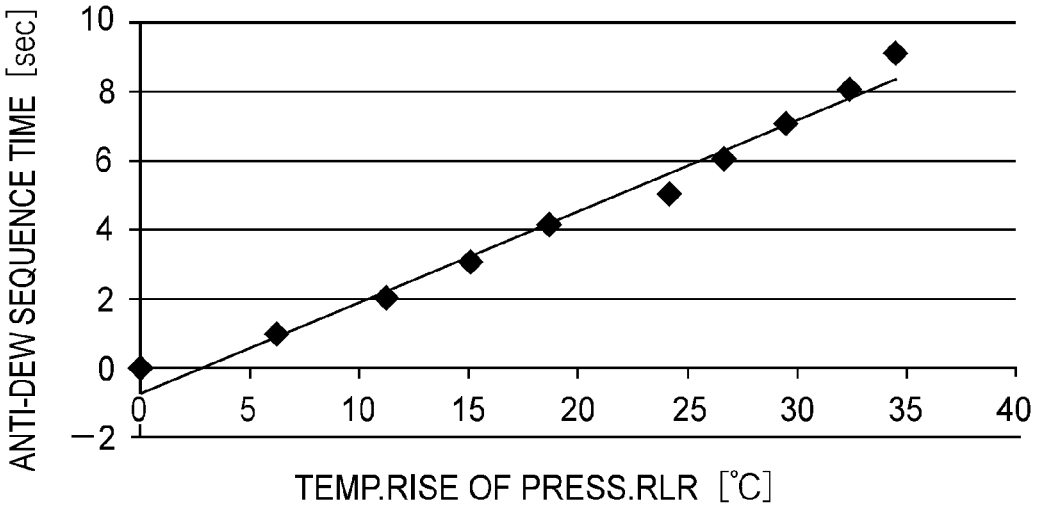
FIG. 7 shows a relation between a dew condensation countermeasurement sequence time and a temperature rise of the pressing roller.

Part (a) of FIG. 7 is a Table showing a relation between the dew condensation countermeasurement sequence time (pre-rotation extension time, Continuation Time (sec)) required to suppression the dew condensation and a rise temperature of the pressing roller in the extension time, under the measuring condition of this embodiment, and part (b) of FIG. 7 is plots of the data of part (a) of FIG. 7. Here, the dew condensation countermeasurement sequence is a sequence for raising the temperature of the pressing roller 115 to a temperature with which the temperature of the pressing roller 115 is enough to suppress the dew condensation. If it is assumed that the temperature rise of the pressing roller 115 in the time period from the start of the pre-rotation to the sheet reaching the fixing portion (fixing nip), without the extension of the pre-rotation is 53 degree C., the temperature rise of the pressing roller 115 in the extension period of the pre-rotation (addition temperature) ΔTfsr can be expressed as follows: Here, the temperature of 53 degree C. is the rise of the temperature in that case of most dull temperature rise which occurs when the power source voltage for heater is low, and the ambient temperature is low.

$$\Delta Tfsr=Tfsr-Tenv-53 \quad (3)$$

By supplementing between the plots of FIG. 7, the relation between the dew condensation countermeasurement sequence time (extension time) Continuation Time (sec) and the temperature (addition temperature) ΔTfsr of the pressing roller 115 rising in the extension time can be expressed as follows:

$$\text{Continuation Time(sec)}=0.259\times\Delta Tfsr-0.646 \quad (4)$$

Here, I, Henv, Tenv, Tfsr, ΔTfsr and Continuation Time in equations 1-equation 4 are as follows:

I: water content of paper sheet (%);

(water content of paper I=((paper mass in a wet condition)−(paper mass in a dry condition))/(paper mass in the wet condition);

Henv: relative humidity (%);

Tenv: ambient temperature (degree C.);

Tfsr: non-dew-condensation-temperature (degree C.);

ΔTfsr: temperature rise of the pressing roller temperature (addition temperature) (degree C.) in the extension time;

Continuation Time: dew condensation countermeasurement sequence time (sec).

The calculation is made using equations 1-4 on the basis of the humidity and temperature detected by the ambient condition sensor 130 to determine the dew condensation countermeasurement sequence time. For example, when the relative humidity is 80%, and the ambient temperature is 23 degree C., the dew condensation countermeasurement sequence time (pre-rotation extension time) is calculated to be 5.25 sec.

As described in the foregoing, according to this embodiment, the water content of paper is calculated from the relative humidity, the pressing roller temperature not resulting in the dew condensation is calculated from the water content of paper, and the execution time of the dew condensation countermeasurement sequence is calculated from the pressing roller temperature, and then the operation is carried out.

Figure 8:
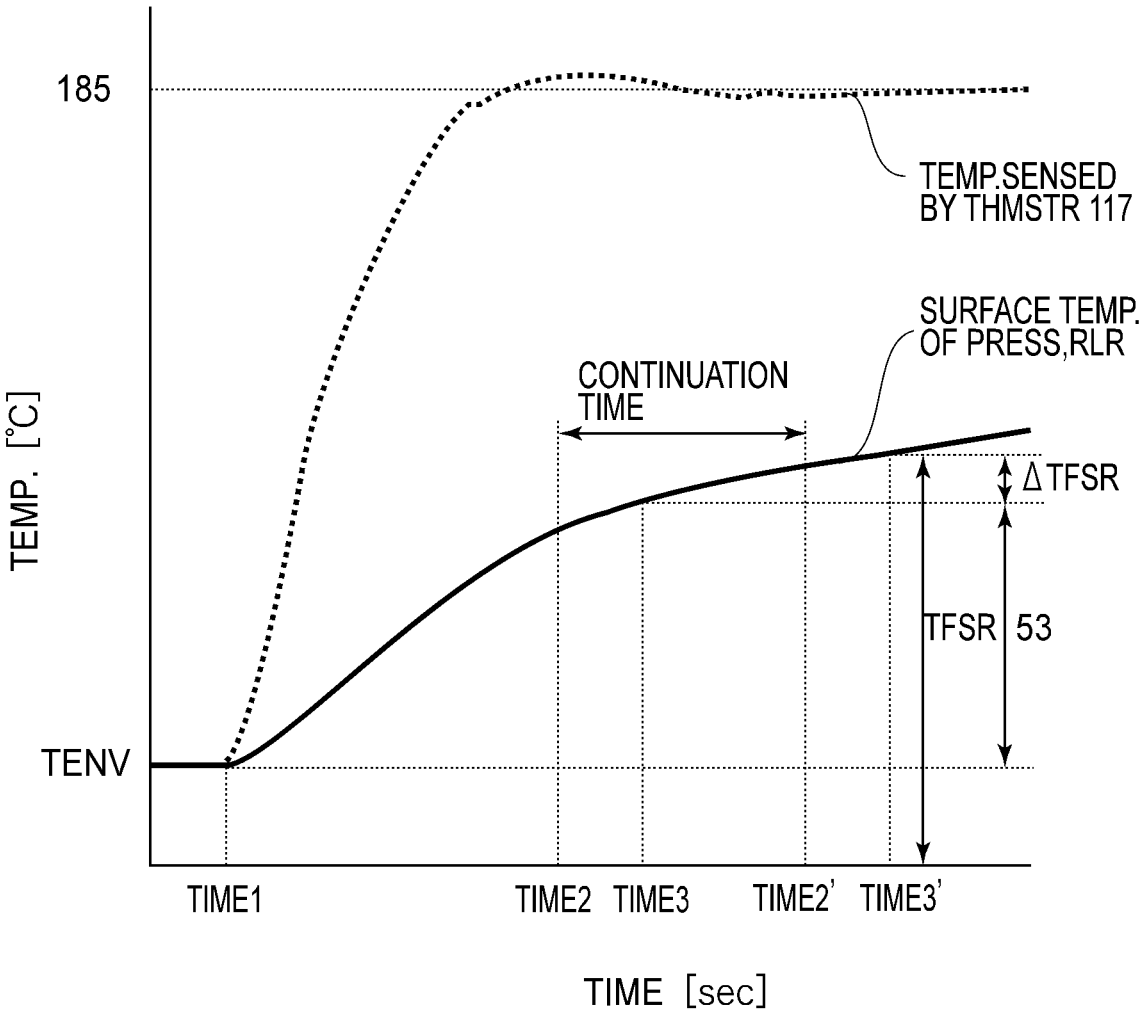
FIG. 8 shows temperature changes of the heater and the pressing roller when the dew condensation countermeasurement sequence is carried out and when it is not carries out.

By doing so, the necessary minimum execution time of the dew condensation countermeasurement sequence to prevent the dew condensation can be correctly calculated. By this, the dew condensation of the pressing roller 115 can be prevented with minimum deterioration of the FPOT and minimum waste of the electric energy consumption required for the dew condensation prevention. FIG. 8 shows a relation between the changes of the detected temperature of the thermister 117 and the pressing roller temperature, and the ambient temperature Tenv, the non-dew-condensation-temperature Tfsr, the addition temperature ΔTfsr and the extension time Continuation Time, after the start of the pre-rotation. In this Figure, Time1 is the pre-rotation start timing, Time2 is the sheet feeding start timing in the case of 0 sec extension time (the dew condensation countermeasurement sequence is not executed), and Time3 is the timing at which a leading end of the sheet reaches the fixing nip in the case of 0 sec extension time. In addition, Time2' is the sheet feeding start timing when the extension time is not 0 sec (the dew condensation countermeasurement sequence is executed), and Time3' is the timing at which the leading end of the sheet reaches the fixing nip when the extension time is not 0 sec.

As shown in FIG. 8, when the dew condensation countermeasurement sequence is executed, the control operation is continued so that the heater temperature is maintained at the control target temperature also after the detected temperature of the thermister 117 (≈the temperature of the heater 118) reaches the control target temperature (185 degree C. in this example) suitable for the fixing process, by which the temperature of the pressing roller is raised up to the non-dew-condensation-temperature Tfsr using the heat of the heater 118.

In this manner, the controller sets warming-up time for the fixing portion (the period Time1–Time3 or the period Time1–Time3') so that the temperature of the pressing roller at the time when the recording material enters the nip becomes the temperature calculated on the basis of the ambient temperature and the ambient humidity.

If the size and/or kind of the printing sheet changes, the amount of the water vapor discharged from the sheet changes, and therefore, it is preferable to change the calculation equation for calculating the dew condensation countermeasurement sequence time, corresponding to the size and/or the kind of the sheet. This will be described in embodiment 3.

Embodiment 2

In Embodiment 1, the calculation is described as to the optimum dew condensation countermeasurement sequence time for a specified control target temperature of the heater (185 degree C.) when the first sheet recording material is fixed. In Embodiment 2, the control target temperature of the heater 118 at the time when the first sheet recording material is fixed (target temperature for the first sheet print) can be set at different levels. An optimum control target temperature when the unfixed toner image is fixed changes depending on various conditions (the kind of paper, the density of the toner image or the like) when the fixing process is carried out, and therefore, the control target temperature is generally not constant.

If the target temperature of the first print changes, the amount of the water vapor discharged from the recording material at the time of the fixing process on the first sheet. For example, in the case of the control target temperature at the time of fixing processed of the first sheet being higher than 185 degree C., the amount of the water vapor generated at the time of the fixing process of the first sheet is larger than in the case of 185 degree C. of the target temperature, with high possibility. Therefore, it is preferable that the temperature of the pressing roller to be assured until the first sheet reaches the fixing nip is higher than 185 degree C. On the contrary, the control target temperature at the time of the fixing process of the first sheet is low, the temperature of the pressing roller to be assured until the first sheet reaches the fixing nip may be low. In this case, the extension time described in Embodiment 1 may be short, and therefore, the electric energy consumption can be saved, and the FPOT can be shortened.

Under the circumstances, in this embodiment, the dew condensation countermeasurement sequence time is corrected corresponding to a target temperature in the printing. FIGS. 1, 2, 4 of Embodiment 1 apply to this embodiment as to the schematic structure of the image forming apparatus, block diagram of the control system and the flow chart of the dew condensation countermeasurement control in the print, and therefore, the descriptions thereof are omitted for simplicity.

Figure 9:
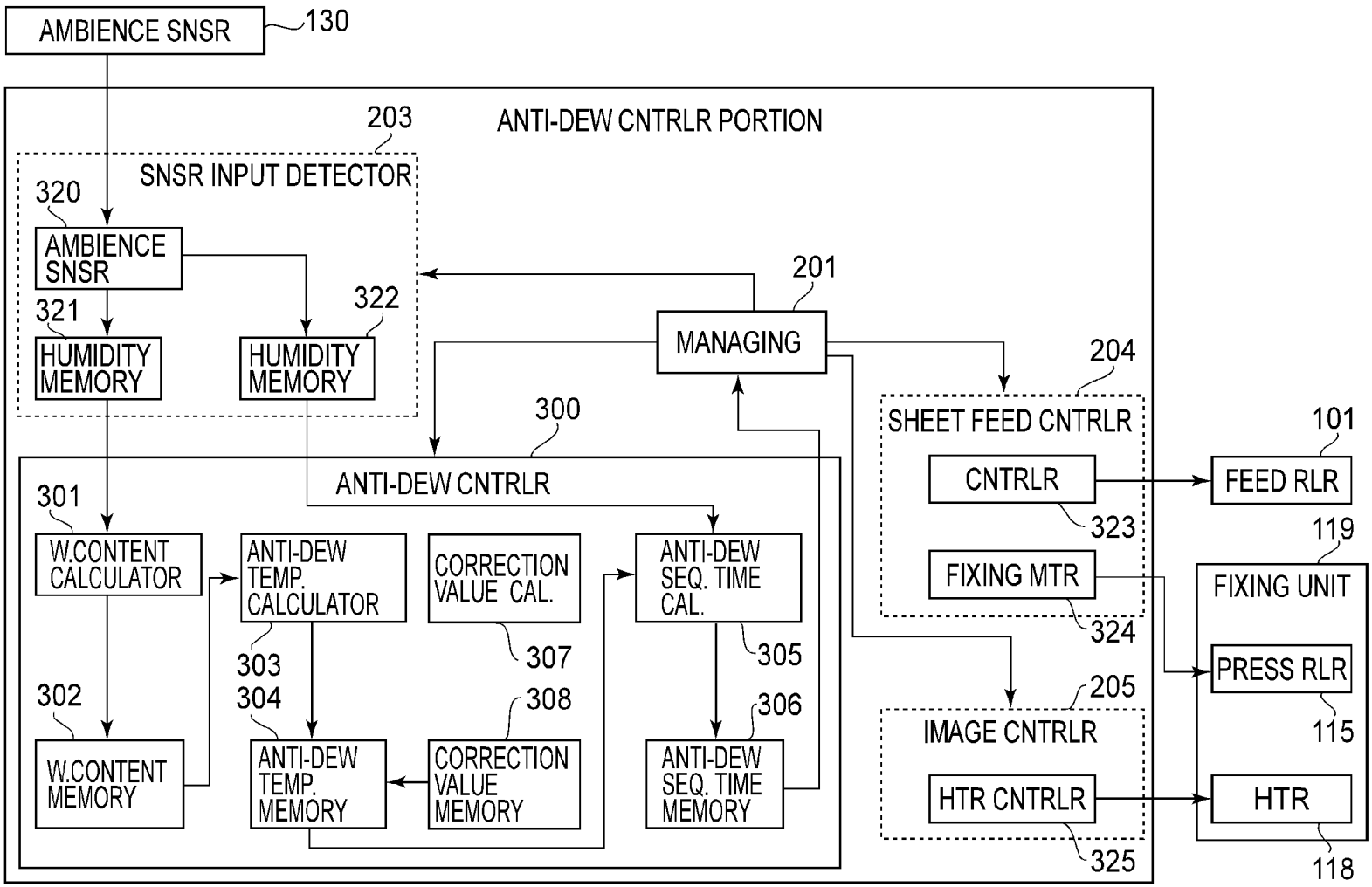
FIG. 9 Embodiment 2 is a block diagram of a controller relating to a dew condensation countermeasurement control according to Embodiment 2.

FIG. 9 is a block diagram showing a controller relating to a dew condensation countermeasurement controller for carrying out the dew condensation countermeasurement control of this embodiment. The block diagram of FIG. 9 is different from the block diagram of FIG. 3 in that the block diagram of FIG. 9 includes a correction value storing portion 308 storing the values calculated by a correction value calculating portion 307.

The parameters required for calculation of the extension time are the same as those measured in embodiment 1.

When a temperature correction value ΔTfsr' (degree C.) required when the target temperature Tprint in the printing changes from 185 degree C. by 1 degree C. is 2.32 degree C., the following applies:

$$\Delta Tfsr'(\text{degree C.})=2.32\times(T\text{print}-185) \quad (5)$$

The calculation of the dew condensation countermeasurement sequence correction time Time C (sec) uses the temperature ΔTfsr (degree C.) calculated from equations 1-3 of Embodiment 1 and the correction value ΔTfsr' (degree C.) calculated by equation 5 and equation 4. More particularly, the correction time Time C (sec) can be expressed as follows, using the temperature ΔTfsr (degree C.), the correction value ΔTfsr' (degree C.) and equation 4.

$$\text{Time } C(\text{sec})=0.259\times(\Delta Tfsr+\Delta Tfsr')-0.646 \quad (6)$$

By equations 5 and 6, the dew condensation countermeasurement sequence time can be calculated corresponding to the target temperature in the printing. For example, when the relative humidity is 80%, the ambient temperature is 23 degree C., and the target temperature for the first sheet printing is 190 degree C., then the dew condensation countermeasurement sequence time (Continuation Time) is calculated as 8.3 sec.

The dew condensation countermeasurement sequence time is shorter when the control target temperature at the time of the fixing process of the first sheet in a print job (continuous print job) of printing on a plurality of recording materials is lower.

As described in the foregoing, according to this embodiment, the optimum dew condensation countermeasurement sequence time can be calculated in accordance with the target fixing temperature in the printing. By this, the dew condensation of the pressing roller 115 can be prevented with minimum deterioration of the FPOT and minimum waste of the electric energy consumption required for the dew condensation prevention.

Embodiment 3

In the description of Embodiments 1, 2, the dew condensation countermeasurement sequence time is calculated for A3 size sheet. When the paper size is different, the amount of the water vapor discharged from the sheet is different.

In view of this, in Embodiment 3, the non-dew-condensation-temperature and/or the dew condensation countermeasurement sequence time is changed in accordance with the paper size in the printing operation. Here, the description will be made as to the calculation of the dew condensation countermeasurement sequence time for the A4 size. FIGS. 1, 2, 4, 8, 9 of Embodiments 1 and 2 apply to this embodiment as to the schematic structure of the image forming apparatus, the block diagram of the control system, the controller for the dew condensation countermeasurement control, and the flow chart of the dew condensation countermeasurement control in the print, and therefore, the descriptions thereof are omitted for simplicity.

The calculation control for the dew condensation countermeasurement sequence time of this embodiment will be described. The measuring conditions under which parameters required to calculate the delay time is as follows:

Paper size: A4;

Kind of paper: CS680 (available from Canon-Kabushiki Kaisha);

Standing condition: a 10 mm stack of print sheets is taken out of a package and stand it for 48 hours;

Printing condition: the printer stands in the off-state for not less than 3 hours, and then the main switch is rendered ON to start printing;

Control target temperature of the fixing device (heater) in the first sheet processing: 185 degree C.

Figure 10:
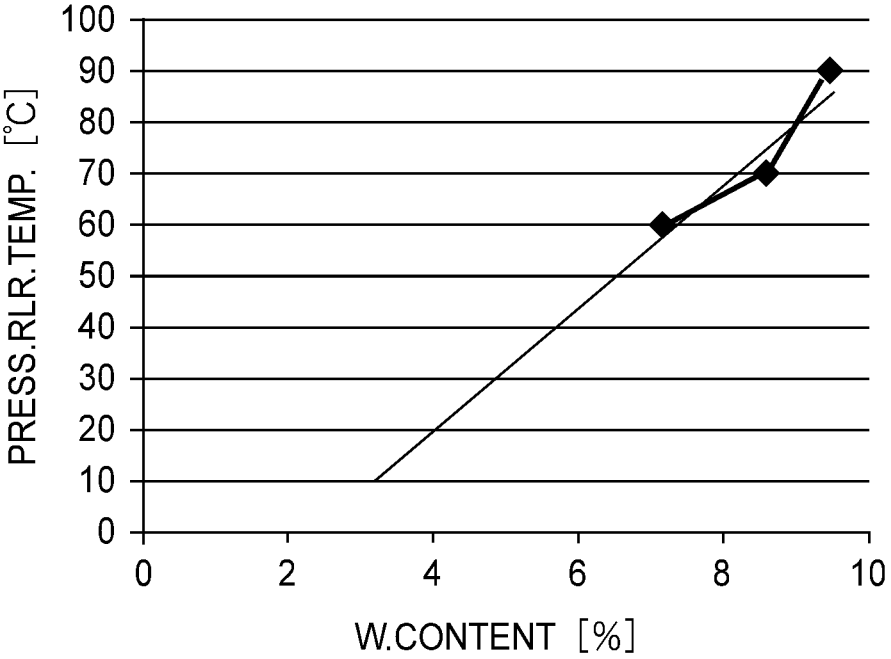
FIG. 10 shows a relation between the non-dew-condensation-temperature and the water content of paper according to Embodiment 3 (A4 size).

FIG. 10 shows a relation between the non-dew-condensation-temperature Tfsr (degree C.) and the water content of paper I (%) in the case of printing on the A4 size sheet. Part (a) of FIG. 10 is a Table showing a relation between the non-dew-condensation-temperature Tfsr (degree C.) and the water content I (%), and part (b) of FIG. 10 are plots of the data of part (a) of FIG. 6. By interpolating between the plots of FIG. 10, the relation between the non-dew-condensation-temperature Tfsr (degree C.) and the water content I (%) can be expressed as follows:

$$Tfsr(\text{degree C.})=11.984\times I-27.731 \quad (7)$$

In this embodiment, the equations 1, 3 and 4 can be utilized, and therefore, the dew condensation countermeasurement sequence time can be calculated by the equations 1, 7, 3 and 4. For example, when the relative humidity is 80%, the dew condensation countermeasurement sequence time is calculated as 1.64 sec. When the size of the recording material is small, the dew condensation countermeasurement sequence time is short.

As described in the foregoing, according to this embodiment, the optimum dew condensation countermeasurement sequence time can be calculated in accordance with the paper size. By this, the dew condensation of the pressing roller 115 can be prevented with minimum deterioration of the FPOT and minimum waste of the electric energy consumption required for the dew condensation prevention.

In CS680 this embodiment, the description has been made as to the A4 size, but the control of calculating the optimum dew condensation countermeasurement sequence time is possible for other kinds of paper or paper sizes. If it is not proper to us the ambient temperature as the temperature of the pressing roller 115 in the pre-rotation start, a temperature deducing means for deducing the temperature of the pressing roller 115, for example may be provided. By doing so, the additional temperature ΔT of the pressing roller 115 can be calculated in accordance with the deduced temperature of the pressing roller 115, and the optimum dew condensation countermeasurement sequence time can be calculated. The temperature deducing means preferably uses a fixing thermister 117 or the elapsed time (rest time) from the completion of the previous fixing operation.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 259222/2011 and 243589/2012 filed Nov. 28, 2011 and Nov. 5, 2012, respectively which are hereby incorporated by reference.

What is claimed is:

1. An image forming apparatus comprising:

an image forming station configured to form an unfixed image on a recording material;

a fixing portion configured to heat and fix an unfixed image formed on the recording material, said fixing portion including a heater, a fixing rotatable member, and a pressing roller cooperative with said fixing rotatable member to form a nip for nipping and feeding the recording material;

an ambient condition sensor configured to detect an ambient temperature and an ambient humidity; and a controller configured to control said fixing portion and to control a conveyance of the recording material, wherein said controller starts, upon receiving print instructions, electric power supply to said heater so as to raise a temperature of said fixing portion to a control target temperature for a fixing operation, and wherein said controller sets a time period from the timing at which the temperature of the fixing portion reaches the control target temperature to the timing at which the recording material enters the nip, on the basis of the ambient temperature and the ambient humidity.

2. An apparatus according to claim 1, wherein said controller corrects the time period in accordance with the control target temperature of said fixing portion at the time of a fixing operation of a first recording material by the nip.

3. An apparatus according to claim 2, wherein the time period decreases with a decrease of the control target temperature.

4. An apparatus according to claim 1, wherein said controller corrects the time period in accordance with a size of the recording material.

5. An apparatus according to claim 4, wherein the time period decreases with a decrease of the size of the recording material.

6. An apparatus according to claim 1, wherein said fixing rotatable member includes a belt.

7. An apparatus according to claim 6, wherein said fixing portion includes a heater contacted to an inner surface of said endless belt.

8. An image forming apparatus comprising:

an image forming station configured to form an unfixed image on a recording material;

a fixing portion configured to heat and fix an unfixed image formed on the recording material, said fixing portion including a fixing rotatable member, and a pressing roller cooperative with said fixing rotatable member to form a nip for nipping and feeding the recording material;

an ambient condition sensor configured to detect an ambient humidity; and a controller configured to control said fixing portion and to control a conveyance of the recording material, wherein said controller sets a start timing of feeding of a first recording material on the basis of the ambient humidity, and wherein said controller corrects the sheet feeding start timing in accordance with a control target temperature of said fixing portion at the time of a fixing operation of the first recording material by the nip.

9. An apparatus according to claim 8, wherein the start timing advances with a decrease of the control target temperature.

10. An apparatus according to claim 8, wherein said controller corrects the sheet feeding start timing in accordance with a size of the recording material.

11. An apparatus according to claim 10, wherein the start timing advances with a decrease of the size of the recording material.

12. An apparatus according to claim 8, wherein said fixing rotatable member includes a belt.

13. An apparatus according to claim 12, wherein said fixing portion includes a heater contacted to an inner surface of said endless belt.

14. An apparatus according to claim 1, wherein the time period increases with an increase of the ambient humidity.

15. An image forming apparatus comprising:

an image forming station configured to form an unfixed image on a recording material;

a fixing portion configured to heat and fix an unfixed image formed on the recording material, said fixing portion including a heater, a fixing rotatable member, and a pressing roller cooperative with said fixing rotatable member to form a nip for nipping and feeding the recording material;

an ambient condition sensor configured to detect an ambient humidity; and a controller configured to control said fixing portion and to control a conveyance of the recording material, wherein said controller sets a time period from the timing at which the temperature of the fixing portion reaches a control target temperature to the timing at which the recording material enters the nip, on the basis of the ambient humidity.

16. An apparatus according to claim 15, wherein the time period increases with an increase of the ambient humidity.

17. An apparatus according to claim 16, wherein said controller corrects the time period in accordance with the control target temperature of said fixing portion at the time of a fixing operation of a first recording material by the nip.

18. An apparatus according to claim 17, wherein the time period decreases with a decrease of the control target temperature.

19. An apparatus according to claim 15, wherein said controller corrects the time period in accordance with a size of the recording material.

20. An apparatus according to claim 19, wherein the time period decreases with a decrease of the size of the recording material.

21. An apparatus according to claim 15, wherein said fixing rotatable member includes a belt.

22. An apparatus according to claim 21, wherein said fixing portion includes a heater contacted to an inner surface of said endless belt.

* * * * *